US008867775B2

(12) United States Patent
Vissia et al.

(10) Patent No.: US 8,867,775 B2
(45) Date of Patent: Oct. 21, 2014

(54) COMBINED DEVICE AUDIO PANEL

(75) Inventors: Greg Vissia, Portland, OR (US); Jeff Anderson, Camas, WA (US)

(73) Assignee: Logitech Europe S.A., Lausanne (CH)

( * ) Notice: Subject to any disclaimer, the term of this patent is extended or adjusted under 35 U.S.C. 154(b) by 207 days.

(21) Appl. No.: 13/454,998

(22) Filed: Apr. 24, 2012

(65) Prior Publication Data

US 2012/0275636 A1 Nov. 1, 2012

Related U.S. Application Data

(60) Provisional application No. 61/479,972, filed on Apr. 28, 2011.

(51) Int. Cl.
*H04R 25/00* (2006.01)

(52) U.S. Cl.
USPC ..... 381/388; 381/333; 381/387

(58) Field of Classification Search
USPC ..... 381/301, 306, 333–334, 386–388
See application file for complete search history.

(56) References Cited

U.S. PATENT DOCUMENTS

| | | | | |
|---|---|---|---|---|
| 6,151,401 | A * | 11/2000 | Annaratone | 381/388 |
| 6,760,456 | B1 * | 7/2004 | Annaratone | 381/306 |
| 7,916,889 | B2 * | 3/2011 | Takakusaki | 381/388 |
| 8,494,186 | B2 * | 7/2013 | Lee et al. | 381/388 |

* cited by examiner

*Primary Examiner* — Suhan Ni
(74) *Attorney, Agent, or Firm* — Kilpatrick Townsend & Stockton LLP

(57) ABSTRACT

Aspects of the present invention may provide audio devices, which may be included in protective covers, suited for use with tablet computers and the like. Embodiments may include audio devices including a substantially tablet-shaped rigid housing. The housing may include a top surface, a bottom surface, and a recess in the top surface. A relatively flat audio speaker may be received in the recess of the housing, and may be pivotally mounted to the housing such that a free end of the speaker is movable between a closed position and an open position.

10 Claims, 7 Drawing Sheets

COMBINED DEVICE AUDIO PANEL

CROSS-REFERENCES TO RELATED APPLICATIONS

The present application is a non-provisional application of and claims priority to U.S. Provisional Application No. 61/479,972, filed on Apr. 28, 2011, the entire contents of which are herein incorporated by reference for all purposes.

BACKGROUND OF THE INVENTION

Tablet-style computers have become more popular as the related technologies of touch-screens, flat panel monitors, and low-profile computing hardware have advanced. Currently, several manufacturers offer various tablet-computing devices with broad capabilities, including, for example, displaying movies, running computer games, and playing audio files.

Despite the advances in computing power and display capabilities of such devices, there are still limitations in the ability to produce high-quality sound in the limited dimensions of these ever-thinner devices. In general, the small form factor design of consumer electronics tablets limits them to poor audio due to the nature of acoustic physics. Accordingly, there exist ongoing needs to provide improved audio devices for use with computing devices, such as tablet computers. In addition, there is an ongoing consumer need for protective cases for portability of their tablet devices.

BRIEF SUMMARY OF THE INVENTION

Aspects of the present invention may provide audio devices, which may be included in protective covers, suited for use with tablet computers and the like. As used herein, computing devices, and the like, should be understood as including all microprocessor-operated devices with audio playback capabilities, typically performed via onboard memory, CDs, network communications, or other broadcast reception. Embodiments may include audio devices including a substantially tablet-shaped rigid housing. The housing may include a top surface, a bottom surface, and a recess in the top surface. A relatively flat audio speaker may be received in the recess of the housing, and may be pivotally mounted to the housing such that a free end of the speaker is movable between a closed position and an open position.

Embodiments may include means for joining the housing to a tablet computer, such as, for example, magnets, surface contours, locking mechanisms, and the like. In embodiments, the means for joining the housing to a tablet computer may include a plurality of magnets disposed on the top surface. Such magnets may be positioned to substantially correspond to magnets included in the tablet computer, and/or various tablet computing devices.

In embodiments, the bottom surface of the housing may include hole patterns, perforations and/or the like, and allow an air flow between the recess and the bottom surface of the housing.

In embodiments, the upper surface may include a recessed contour proximate to the free edge of the speaker. At least one of a plurality of magnets may be disposed in the contour.

In embodiments, the speaker may be configured to emit sound toward the bottom surface in the closed position.

In embodiments, the speaker may be configured to hold the tablet computer at an angle of at least 45 degrees above horizontal in the open position.

In embodiments, the speaker and the means for joining the housing to a tablet computer may be configured to hold the tablet computer at an angle of at least 45 degrees above horizontal in the open position.

In embodiments, the housing may have a length and width that substantially correspond to a length and width of a tablet computer that the audio device is designed to be used with. For example, the housing may have a length in a range of approximately 7-12 inches and a width in a range of approximately 5-10 inches.

In embodiments, exemplary audio devices may include various other units, such as a power unit, a control unit, and/or a communication module. Communication modules may be configured to receive audio data and/or signals and to provide the audio data to the speaker, and may include, for example, wireless receivers, USB ports, audio jacks, etc.

According to further aspects of the invention, protective covers may be provided for use with a computing device. Exemplary protective covers may include a substantially tablet-shaped housing including a front surface and a back surface. In embodiments, the protective cover may be joined with one or more flaps along an edge of the housing. The flap may be hinged to the housing such that the flap can pivot, for example, from the front surface to the back surface of the housing, or various angles in between.

In embodiments, the flap and/or the housing may include a relatively flat audio speaker. In embodiments, a speaker disposed in a flap of the device may be positioned at various angles suitable for a desired audio experience. In embodiments, the protective cover may include means for closing the flap to the housing, which may protect a speaker disposed on an inner surface of the flap by placing the speaker against the housing.

In embodiments, the housing and/or the flap may include a plurality of magnets configured to join with the computing device.

In embodiments, the flap may be configured to hold the protective cover and/or the computing device in a substantially upright position.

In embodiments, the housing of the protective cover may have a length and width that substantially correspond to a length and width of a tablet computer that the cover is designed to be used with, for example, the housing may have a length in a range of approximately 7-12 inches and a width in a range of approximately 5-10 inches.

In embodiments, the protective cover may include various other units, such as a power unit, a control unit, and/or a communication module. Communication modules may be configured to receive audio data and/or signals and to provide the audio data to the speaker, and may include, for example, wireless receivers, USB ports, audio jacks, etc.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced. In the drawings.

DETAILED DESCRIPTION OF THE INVENTION

Figure 1:
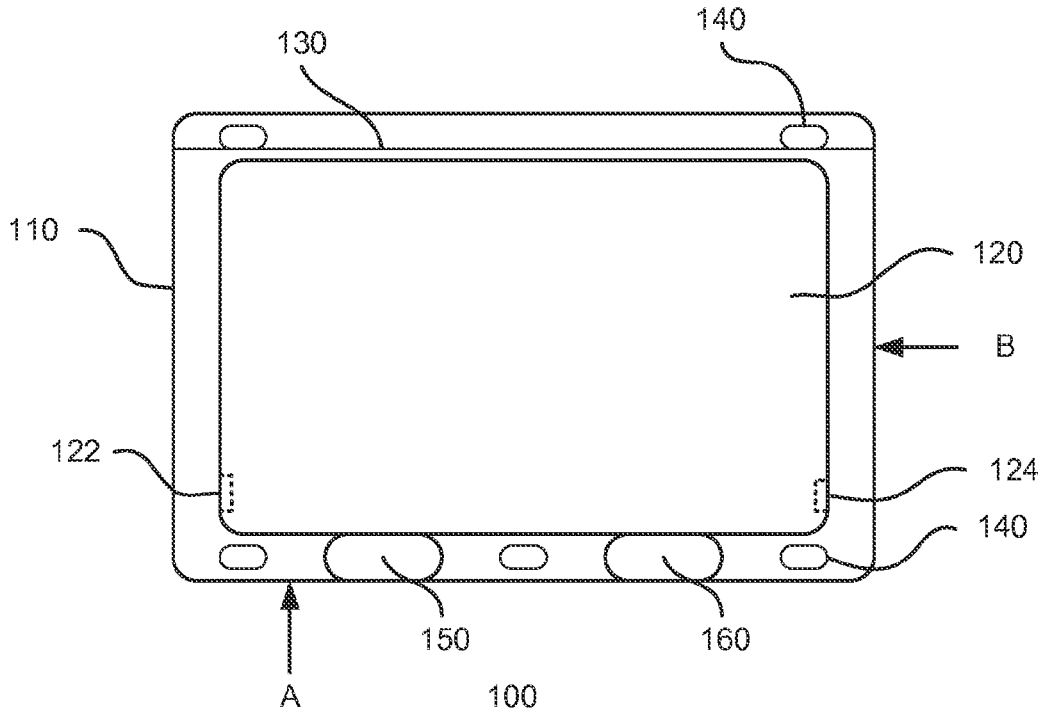
FIG. 1 is a top-down view of an exemplary audio device according to aspects of the invention.

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a flap" is a reference to one or more flaps and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

Embodiments of the invention may provide audio devices, which may be included in protective covers, for use with tablet computers and the like.

FIG. 1 is a top-down view of an exemplary audio device according to first aspects of the invention. As shown in FIG. 1, an audio device 100 may include a substantially tablet-shaped (i.e. relatively flat and rectangular) housing 110. The housing 110 may be made from various materials including, for example, plastics, fibreglasses, aluminum and/or other metals and alloys.

A relatively flat speaker 120, e.g. NXT/HiWave and the like, may be received in a recess of the housing 110. The speaker 120 may be mounted to the housing 110 via pins 122 and 124, allowing the speaker 120 to pivot relative to the housing 110. Pins 122, 124 may include various means for adjusting and or securing the pivot angle of the speaker 120. For example, the pivot may include washers, bushings or the like that secure the speaker 120 at any desired angle within the allowable range of rotation, and/or the pivot may include detents and the like to secure the speaker in a number or predetermined angles within the allowable range. Additionally, although shown as pins into the speaker 120, alternative pivot configurations are also possible. For example, the speaker 120 may have spring loaded or other selectively deployable pins that fit in corresponding recesses of the housing, etc.

The housing 110 may also include a plurality of magnets 140 disposed at various locations around the perimeter of the housing. In embodiments, the magnets 140 may be positioned to substantially correspond to the location of magnets included in a tablet computer, and the like, and/or various tablet computing devices. The magnets 140 may be useful in joining and/or positioning a tablet computer and the like to the audio device 100.

Housing 110 may also include a contour 130 in the top surface. Contour 130 is shown running substantially lengthwise proximate to the free end of the speaker 120. One or more of magnets 140 may be positioned near or within the contour 130. As described further below, the contour 130, and the like, with or without magnets 140, may be useful in helping to securely position a computing device with the audio device 100, for example, when the speaker 120 is in an open configuration. In embodiments, the contour may be free of other electrical attachment mechanisms, such as USB plugs and the like, that may be prone to wear and breakage. In embodiments, other securing means, such as clips, hinges, hook and loop fasteners, etc. may be used to detachably secure and/or position a computing device with the audio device 100.

Housing 110 may also include one or more control modules 150 for controlling audio and other functions of the audio device 100, e.g. volume, input, surround sound, etc. Control module 150 may also be configured to control functions of a computing device used with the audio device 100. For example, through wireless or other two-way communication, the audio device 100 may instruct a computing device to perform functions such as play, pause, and/or skip, audio and/or video tracks, and the like. Housing 110 may also include one or more detectors and/or function displays 160 such as, for example, power, volume, or other indicators. Detectors disposed on the housing may also be configured to detect whether a computing device is currently joined with the audio device, and may further distinguish between a "face-to-face" joining, a back-to front joining, and/or an upright joining, etc.

Figure 2:
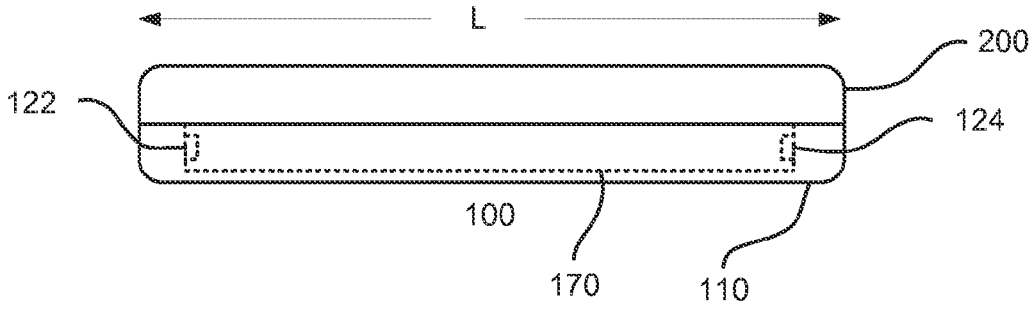
FIG. 2 is a side view showing further details of the audio device depicted in FIG. 1, including a tablet computing device joined to the audio device.

FIG. 2 is a side view, from direction A in FIG. 1, showing further details of the audio device 100 along with a tablet computing device 200 joined to the audio device 100. As shown in FIG. 2, the tablet computing device 200 may be joined to the audio device 100, for example, in a "face-to-face" configuration by magnets 140 and corresponding magnets included in the front surface of tablet computing device 200. Thus, audio device 100 may also act as a protective cover for a screen of the computing device 200. In embodiments, the audio device 100 may also be configured to join with the back of a computing device, e.g. by magnets or other joining means.

As also shown in FIG. 2, the length L of the audio device 100 and the computing device 200 may substantially correspond to one another. As used herein, the length L of the audio device 100 may be understood as substantially corresponding to a rotational axis of the speaker 120 between hinge pins 122, 124. Although shown in FIGS. 1 and 2 as having a length that is relatively long compared to the width of the device, other configurations are also possible, and may include, for example, positioning the rotational axis of the speaker 120 along a relatively short dimension of the device.

As also shown in FIG. 2, the housing 110 may include a recess 170, shown in broken lines, that is configured to receive the speaker 120. The recess 170 may leave a relatively thin bottom of the housing 110 beneath the speaker 120, which may be advantageous in perforating, or otherwise configuring the bottom surface of the housing to allow sound to travel therethrough. In embodiments, the speaker 120 may be configured to emit sound toward the bottom surface of the housing 110 when the speaker 120 is in a closed configuration.

Figure 3:
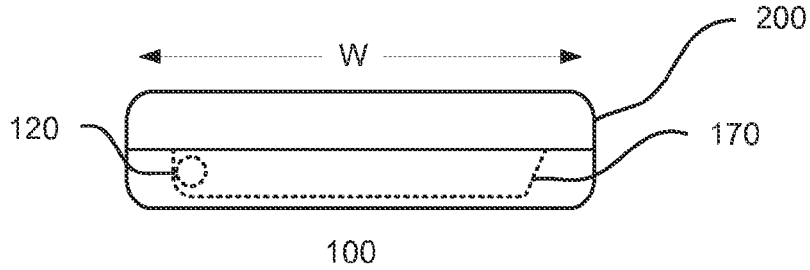
FIG. 3 is a different side view showing further details of the audio device depicted in FIG. 1, including a tablet computing device joined to the audio device.

FIG. 3 is a different side view, from direction B in FIG. 1, showing further details of the audio device 100 along with the tablet computing device 200 joined to the audio device 100. As shown in FIG. 3, the width W of the audio device 100 and the computing device 200 may substantially correspond to one another. As used herein, the width W of the audio device 100 may be understood as substantially in the plane of, and perpendicular to, the rotational axis of the speaker 120 between hinge pins 122, 124.

As also shown in FIG. 3, the recess 170, and speaker 120 (not shown), may be contoured at an angle at the free end of the speaker 120 to allow for easy opening and closing of the speaker 120. This angle may also be beneficial in helping to stably support the computing device 200 in an open configuration, as discussed further below.

Figure 4:
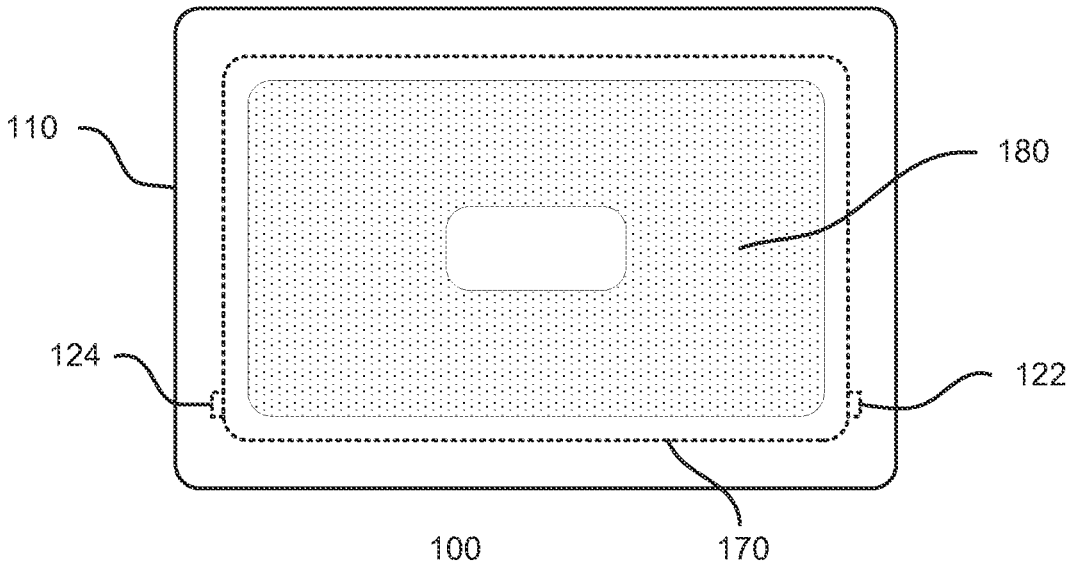
FIG. 4 is a bottom view showing further details of the audio device depicted in FIG. 1.

FIG. 4 is a bottom view showing further details of the audio device 100 depicted in FIG. 1. As shown in FIG. 4, the bottom surface of the housing 110 may be perforated in area 180 to allow, for example, air flow between the recess 170 and the bottom surface of the housing 110. As mentioned above, such configurations, or other hole patterns, may improve audio quality of the speaker 120, particularly when the device is in a closed configuration. Although described as perforations, other means of providing airflow between the recess 170 and the bottom surface of the housing 110 are also possible.

Figure 5:
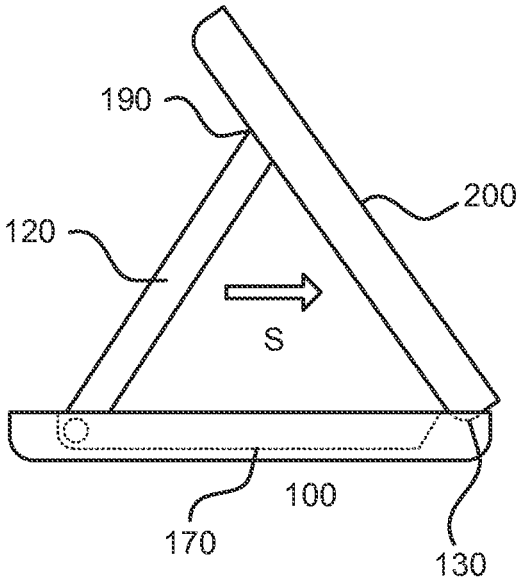
FIG. 5 is a side view showing further details of the audio device depicted in FIG. 1, including a tablet computing device joined to the audio device in an open configuration.

FIG. 5 is a side view showing further details of the audio device 100 and tablet computing device 200 joined together with the audio device 100 in an open configuration. As shown in FIG. 5, the speaker 120 may be rotated out of the plane of the audio device 100, and positioned to provide support to the computing device 200. In embodiments, the speaker 120 may be configured to support the computing device 200 at various angles, e.g. greater than 45 degrees above the plane of the audio device 100. In embodiments, an angle of the free end 190 of the speaker may be set to align with the back of the computing device 200 at a desired viewing angle. The speaker 120 may also be configured to adjust the viewing angle of the computing device 200, e.g. by changing the rotation, and/or hinge position, of the speaker 120. Embodiments may include various means for securing the free end 190 of the speaker to the back of the computing device 200, e.g. high-friction coatings, hook and loop fasteners, magnets, etc.

In embodiments, the pivot axis of the speaker 120 may be switchable, e.g. between the short and long axis of the housing 110, to allow for alternative viewing arrangements and the like.

As mentioned previously, embodiments may include features for aligning the speaker 120 on an opposite axis, and/or aligning the computing device 200 on an opposite axis from that shown in FIGS. 1-5. In other embodiments, the audio device may be pre-configured to align the speaker and the computing device along opposite axes from one another. In either event, by aligning the speaker 120 and the computing device 200 along opposite axes from one another, it may also be possible for the user to configured the audio device, such as audio device 100, to support the computing device, such as computing device 200, in a "T" or "L" configuration, i.e. with the computing device forming the top of the "T", or base of the "L", when viewed from above. In embodiments a side of the speaker 120 may be angled with respect to the axis of rotation to, for example, allow the computing device to be supported at a corresponding angle in the "T" or "L" configuration, rather than a 90 degree upright angle. In embodiments, speaker 120 may include audio speakers on both major surfaces to, for example, allow a stereo-effect from both sides of the "T" or "L" configuration, i.e. with sound coming out from behind the computing device 200 from the "left" and "right" speakers.

As also shown in FIG. 5, the contour 130 in the top surface of the housing may be used to securely position the computing device 200 with the audio device 100 when the speaker 120 is in the open configuration. For example, the contour 130 may be configured to at least partially receive an edge of the computing device, and resist movement of the bottom edge of the computing device. It should also be noted that, although contour 130 is shown as extending along one edge of the housing 110, other arrangements are possible, for example, including contours on opposing axes of the housing to support the computing device 200 in either landscape or portrait orientations. In embodiments, other securing means, such as clips, hinges, hook and loop fasteners, etc. may be used to detachably secure and/or position an edge of the computing device 200 with the audio device 100.

As also shown in FIG. 5, speaker 120 may be configured to emit sound S toward a back of the computing device 200 in the open configuration. This may be desirable, for example, in improving audio quality under certain circumstances by reflecting emitted sound off of the back of the computing device. In embodiments, the speaker 120 may be configured to emit sound from either or both of the front and back surfaces of the speaker. This may be effective, for example, in producing stereo-effects and the like from the audio device by positioning and/or controlling activation of the speakers, e.g. based on left and right channel sounds emitted from opposing sides of the speaker. The audio device controls may also be configured to select between emitting sound from the front, back or both surfaces of the speaker, which may help the user obtain a desired sound quality, depending on, for example, whether the audio device is in an open or closed configuration, ambient noise, etc. In embodiments, the control circuitry of the audio device 100 may have predetermined settings that automatically go into effect depending on whether the device is in an open or closed configuration and/or whether and how a computing device is joined to the audio device. For example, when the audio device is in a closed configuration and a computing device is detected as covering the top surface of the audio device, the back surface of the speaker 120 may be activated and the front surface deactivated.

Figure 6:
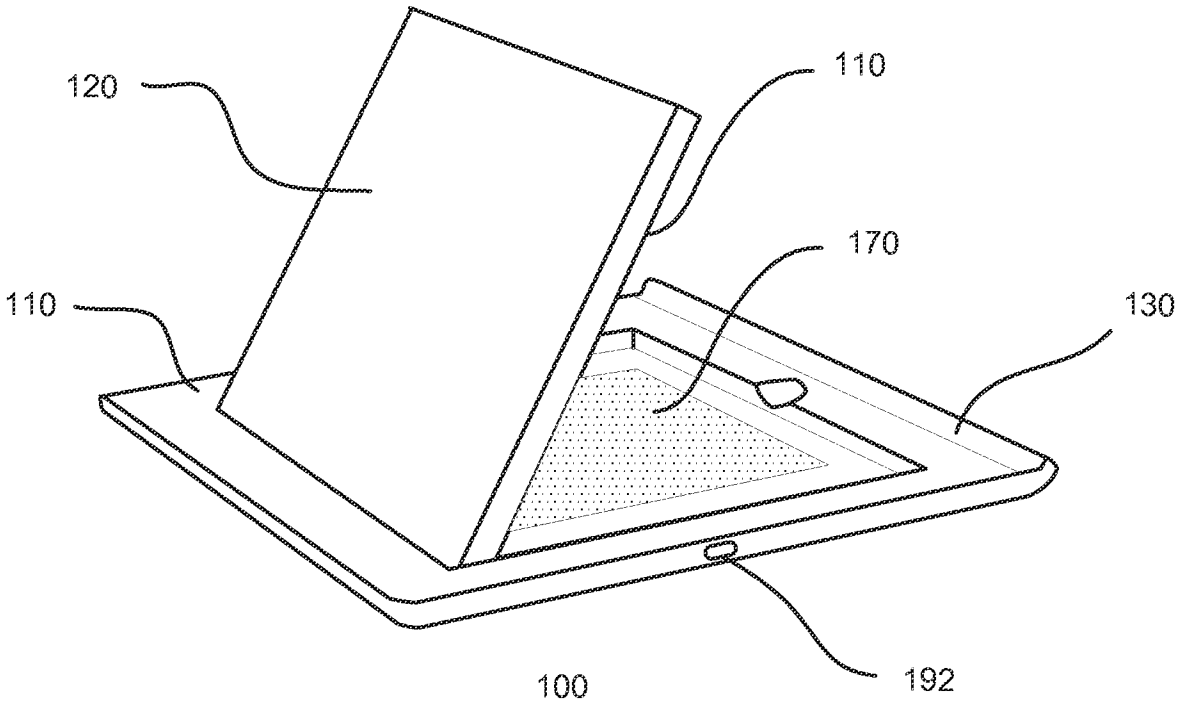
FIG. 6 is an isometric side view showing further details of the audio device depicted in FIG. 1 in an open configuration.

FIG. 6 is an isometric side view showing further details of the audio device 100 depicted an open configuration. As shown in FIG. 6, the perforations in the bottom surface of the housing 110 may penetrate the housing and pass through to the recess 170. It should also be noted that, the speaker 120 may be configured to be positioned in an open configuration even without a computing device to rest on.

As also shown in FIG. 6, housing 110 may include a communication and/or power port 192, e.g. a USB port that provide two-way communication and power to audio device 100.

Figure 7:
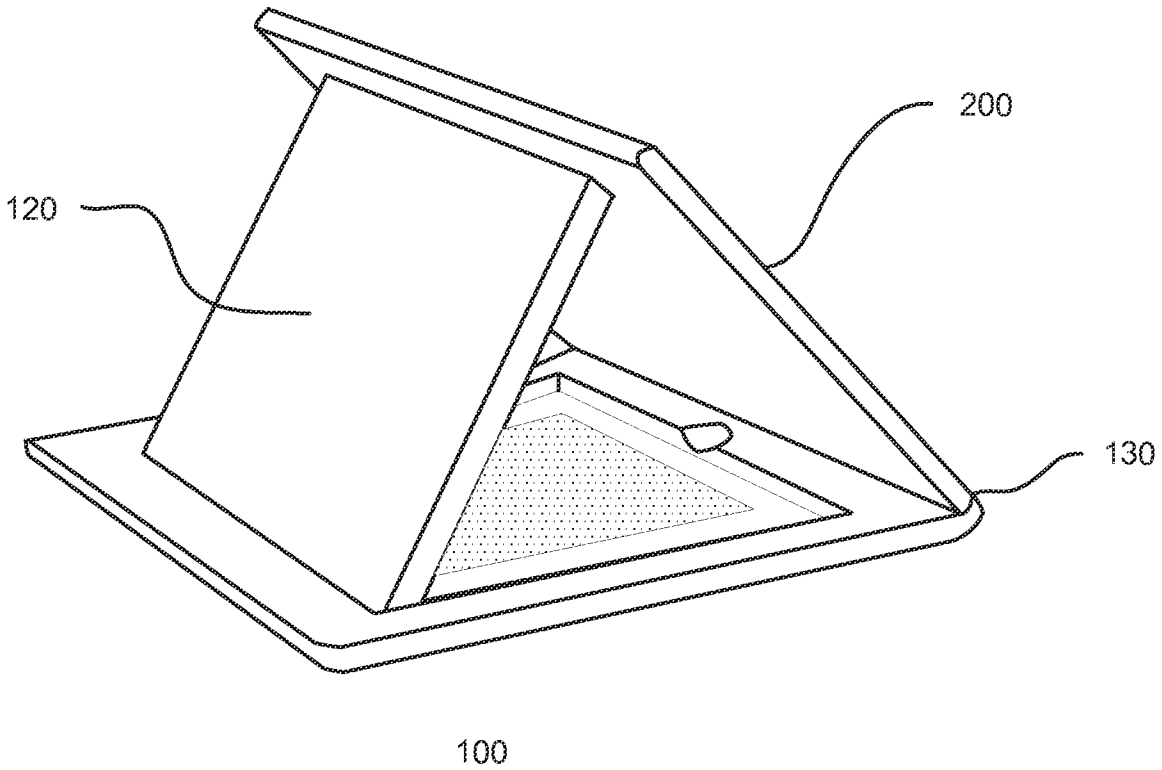
FIG. 7 is an isometric side view of the audio device and tablet computing device depicted in FIG. 5 in an open configuration.

FIG. 7 is an isometric side view of the audio device 100 and tablet computing device depicted in FIG. 5 in an open configuration. As shown in FIG. 7, the computing device 200 may be held in a relatively upright position, e.g. greater than 45 degrees from horizontal, by both the speaker 120 and the contour 130. In embodiments, the positioning of the computing device 200 may be further secured by magnets, such as magnets 140, disposed in the contour 130.

Figure 8:
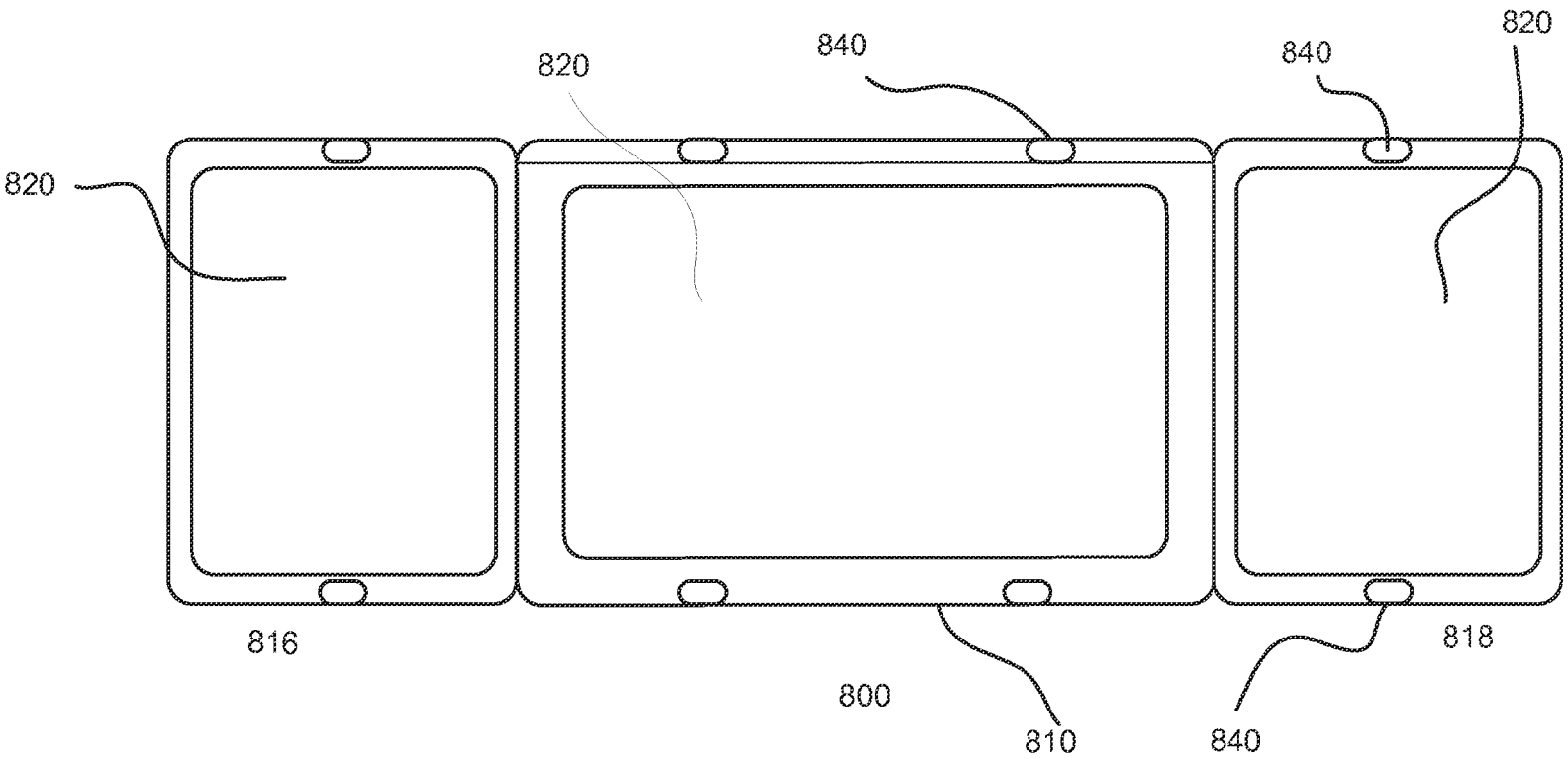
FIG. 8 is a front view of an exemplary protective cover and open flaps according to further aspects of the invention.

FIG. 8 is a front view of an exemplary protective cover and open flaps according to further aspects of the invention. As shown in FIG. 8, protective cover 800 may include a housing 810, which may include features similar to those discussed above with respect to audio device 100 and housing 110. Relatively flat speakers 820 may be received in a recess of the housing 810 and/or included in flaps 816, 818. The flaps 816, 818 may be configured to rotate about the housing 810, e.g., from the front surface of the housing to the back surface of the housing.

The housing 810 and/or flaps 816, 818 may also include a plurality of magnets 840 disposed at various locations around the perimeter of the housing and/or flaps. In embodiments, the magnets 840 may be positioned to substantially correspond to the location of magnets included in a tablet computer, and the like, and/or correspond to one another when the cover is in a closed configuration. The magnets 840 may be useful in joining and/or positioning a tablet computer and the like to the protective cover 800.

Figure 9:
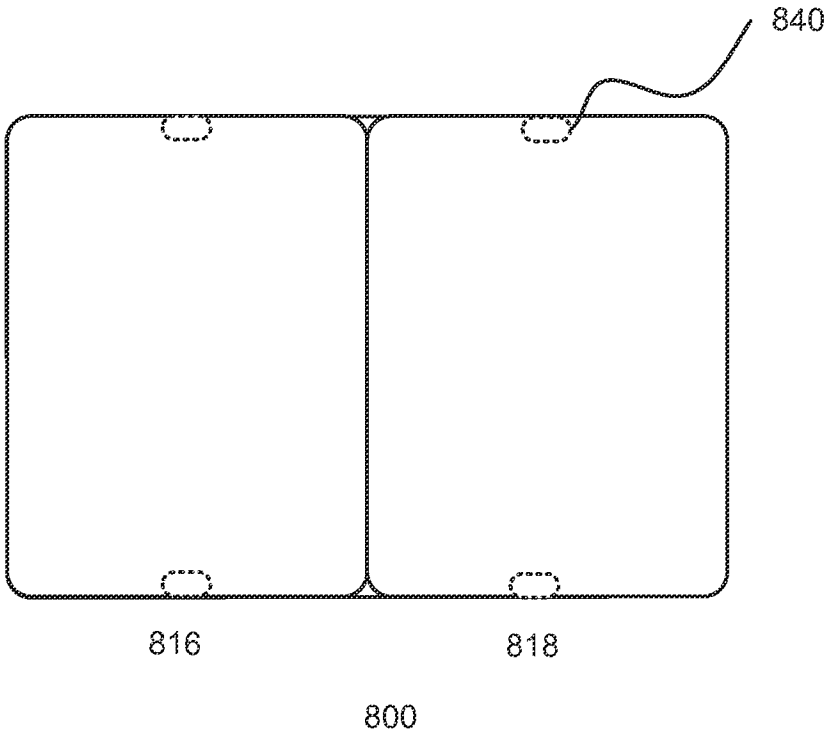
FIG. 9 is a front view of the exemplary protective cover shown in FIG. 8 with the flaps in a closed configuration.

FIG. 9 is a front view of the exemplary protective cover 800 shown in FIG. 8 with the flaps in a closed configuration. As mentioned above, the cover 800 may be configured such that magnets 840 in the housing, and/or flaps 816, 818, correspond to one another in the closed configuration, such that the protective cover 800 may be securely closed. In embodiments, the magnets 840 in the housing, and/or flaps, may be configured to correspond to magnets in a computing device that the protective cover is designed to work with.

In embodiments, by closing the speaker device itself, such flaps may serve to protect the speakers themselves. In such an embodiment, the computing device 200 may not even be in the picture, and the speakers device 100 could be a standalone easily portable speakers device which is kept closed by magnets.

Figure 10B:
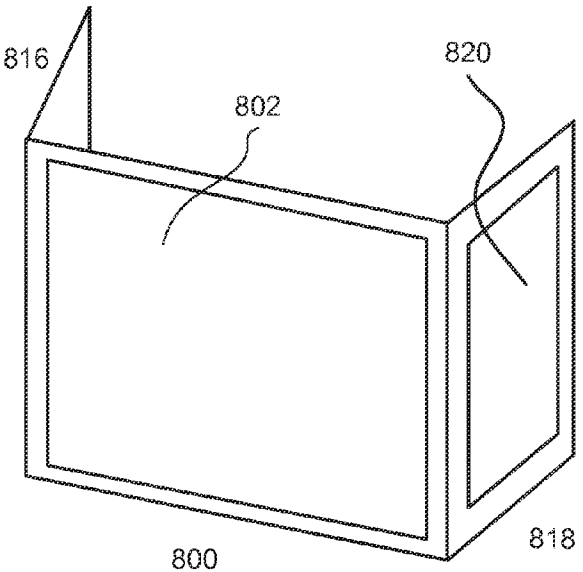
FIGS. 10A and 10B are isometric side views showing further details of the protective cover depicted in FIG. 9 in open configurations.
Figure 10A:
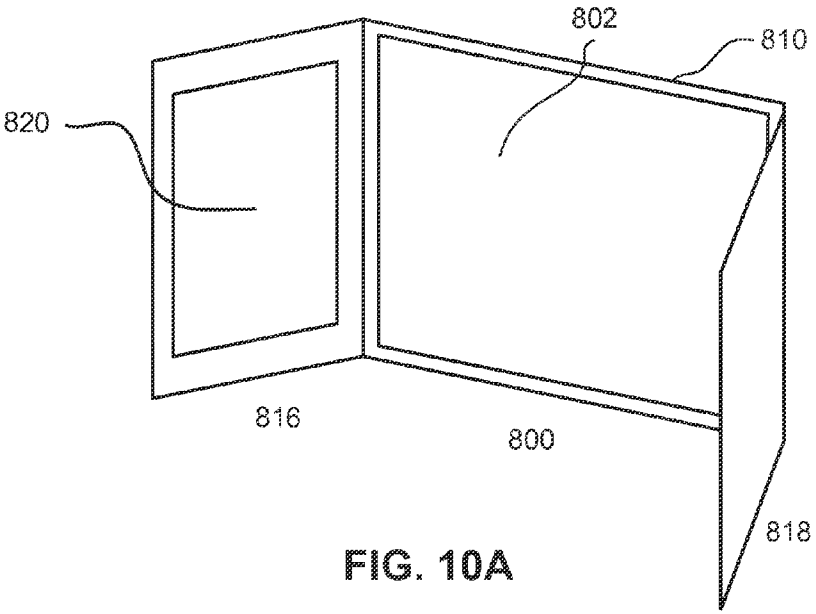

FIGS. 10A and 10B are isometric side views showing further details of the protective cover 800 depicted in FIG. 9 in open configurations. A computing device 802 may be joined to the housing 810 of cover 800 by various means discussed herein. As shown in FIG. 10A, the flaps 816, 818 may be, for example, partially extended toward the front of the cover 800, which may be used, for example, to focus sound emitted from the speakers 820 toward a user.

As shown in FIG. 10B, the flaps 816, 818 may be instead partially extended toward the rear of the cover 800, which may be used, for example, to disperse sound emitted from the speakers 820 and/or to better support the cover 800 and/or any computing device joined to the cover 800.

The description given above is merely illustrative and is not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments.

What is claimed is:

1. An audio device comprising:

a substantially tablet-shaped rigid housing including a top surface, a bottom surface, and a recess in the top surface;

a relatively flat audio speaker that is received in said recess, and is pivotally mounted to the housing such that a free end of the speaker is movable between a closed position and an open position; and means for joining the housing to a tablet computer, wherein, the bottom surface is perforated and allows an air flow between the recess and the bottom surface.

2. The device of claim 1, wherein the means for joining the housing to a tablet computer includes a plurality of magnets disposed on the top surface.

3. The device of claim 2, said top surface further comprising a recessed contour proximate to the free edge of the speaker, wherein, at least one of the plurality of magnets is disposed in the contour.

4. The device of claim 1, wherein the speaker is configured to emit sound toward the bottom surface in the closed position.

5. The device of claim 1, wherein the speaker is configured to hold the tablet computer at an angle of at least 45 degrees above horizontal in the open position.

6. The device of claim 1, wherein the speaker and the means for joining the housing to a tablet computer are configured to hold the tablet computer at an angle of at least 45 degrees above horizontal in the open position.

7. The device of claim 1, wherein the housing has a length and width that substantially correspond to a length and width of a tablet computer that said device is designed to be used with.

8. The device of claim 1, wherein the housing has a length in a range of approximately 7-12 inches and a width in a range of approximately 5-10 inches.

9. The device of claim 1, further comprising a communication module configured to receive audio data and to provide the audio data to the speaker.

10. The device of claim 9, wherein the communication module includes a wireless receiver.

* * * * *